US010937365B2

(12) United States Patent
Yang et al.

(10) Patent No.: US 10,937,365 B2
(45) Date of Patent: Mar. 2, 2021

(54) TEMPERATURE COMPENSATION METHOD AND DEVICE, AND DISPLAY APPARATUS

(71) Applicant: BOE Technology Group Co., Ltd., Beijing (CN)

(72) Inventors: Fei Yang, Beijing (CN); Yi Chen, Beijing (CN); Xiaolong Wei, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 12 days.

(21) Appl. No.: 16/520,542

(22) Filed: Jul. 24, 2019

(65) Prior Publication Data

US 2020/0126482 A1 Apr. 23, 2020

(30) Foreign Application Priority Data

Oct. 19, 2018 (CN) ..... 201811224103.0

(51) Int. Cl.
*G09G 3/3241* (2016.01)
*G09G 3/3275* (2016.01)

(52) U.S. Cl.
CPC ..... *G09G 3/3241* (2013.01); *G09G 3/3275* (2013.01); *G09G 2320/0233* (2013.01); *G09G 2320/041* (2013.01)

(58) Field of Classification Search
CPC ..... G09G 3/30–3258; G09G 2320/04–048
See application file for complete search history.

(56) References Cited

U.S. PATENT DOCUMENTS

| | | | | |
|---|---|---|---|---|
| 10,140,925 | B2 | 11/2018 | Chaji | |
| 2014/0320475 | A1* | 10/2014 | Shin | G09G 3/3275 345/212 |
| 2015/0054722 | A1* | 2/2015 | Kanda | G09G 3/3233 345/77 |
| 2016/0307498 | A1 | 10/2016 | Chaji | |
| 2018/0005583 | A1 | 1/2018 | Chaji | |
| 2018/0182303 | A1 | 6/2018 | Jung et al. | |

FOREIGN PATENT DOCUMENTS

| | | | |
|---|---|---|---|
| CN | 104700772 | A | 6/2015 |
| CN | 104885145 | A | 9/2015 |
| CN | 108257554 | A | 7/2018 |
| EP | 2 881 932 | B1 | 8/2018 |
| KR | 10-2018-0002099 | A | 1/2018 |

OTHER PUBLICATIONS

First Office Action, including Search Report, for Chinese Patent Application No. 201811224103.0, dated Dec. 4, 2019, 25 pages.

* cited by examiner

*Primary Examiner* — Hang Lin
(74) *Attorney, Agent, or Firm* — Westman, Champlin & Koehler, P.A.

(57) ABSTRACT

The present disclosure provides a temperature compensation method and device, and a display apparatus. In the temperature compensation method, a temperature value of a driving transistor corresponding to a light emitting device in the display apparatus is determined according to a photoelectric display signal of the display apparatus and/or an anode voltage signal of the light emitting device, and an electrical parameter offset of the driving transistor is calculated according to the temperature value, so as to perform real-time temperature compensation on a date line signal such as a gate voltage.

12 Claims, 9 Drawing Sheets

TEMPERATURE COMPENSATION METHOD AND DEVICE, AND DISPLAY APPARATUS

CROSS-REFERENCE TO RELATED APPLICATION(S)

This application claims priority to the Chinese Patent Application No. CN201811224103.0, filed on Oct. 19, 2018, which is incorporated herein by reference in its entirety.

TECHNICAL FIELD

The present disclosure relates to the field of display technology, and more particularly, to a temperature compensation method and device for a display apparatus, and a display apparatus.

BACKGROUND

In the field of display technology, Organic Light emitting Diode (OLED) display products have gradually become the development direction of future display technology due to their excellent characteristics such as wide color gamut, wide viewing angle, thinness, light weight, low energy consumption, high contrast, flexibility etc.

Since an OLED display product is in a brightness display mode using voltage-controlled current, brightness is related not only to a display voltage, but also to a mobility K and a threshold voltage Vth of a driving Thin Film Transistor (TFT). In a light emitting process of the OLED, a temperature may rise, which may result in a decrease in K and Vth of the TFT, and thereby driving current on the driving TFT may be unstable, thus resulting in a decrease in quality of a picture. Therefore, it is always the direction of efforts for technicians to improve the quality of the display picture.

SUMMARY

According to a first aspect of the embodiments of the present disclosure, there is provided a temperature compensation method for a display apparatus, comprising:

determining, according to a photoelectric display signal of the display apparatus and/or an anode voltage signal of a light emitting device in the display apparatus, a temperature value of a driving transistor corresponding to the light emitting device in the display apparatus;

determining, according to the temperature value of the driving transistor, a preset correspondence relationship between temperatures and electrical parameters of the driving transistor, and a reference electrical parameter, an electrical parameter offset of the driving transistor; and determining, according to the electrical parameter offset, a temperature compensation value for a data line signal corresponding to the driving transistor in the display apparatus.

In an embodiment, determining a temperature value of the driving transistor comprises:

determining a first full screen temperature according to a brightness signal of the display apparatus or driving current signals of respective driving transistors in the display apparatus;

determining an internal sensed temperature of the driving transistor according to the anode voltage signal of the light emitting device; and determining the temperature value of the driving transistor according to the first full screen temperature and/or the internal sensed temperature.

In an embodiment, the display apparatus comprises a plurality of pixel units, and determining a first full screen temperature according to a brightness signal of the display apparatus comprises:

determining brightness signals of respective pixel units according to display data signals of the respective pixel units; and determining the first full screen temperature according to a sum of brightness signals of the respective pixel units of a multi-frame display picture.

In an embodiment, determining a first full screen temperature according to driving current signals of respective driving transistors comprises:

determining the first full screen temperature according to a sum of driving current signals of the respective driving transistors of a multi-frame display picture.

In an embodiment, determining the temperature value of the driving transistor according to the first full screen temperature and/or the internal sensed temperature comprises:

acquiring an external sensed temperature measured by a temperature sensor disposed outside the display apparatus;

correcting the first full screen temperature according to the external sensed temperature to obtain a second full screen temperature; and determining the temperature value of the driving transistor according to the second full screen temperature and/or the internal sensed temperature.

In an embodiment, the electrical parameter of the driving transistor comprises a mobility and a threshold voltage, the reference electrical parameter comprises a reference mobility and a reference threshold voltage, and determining an electrical parameter offset of the driving transistor according to the temperature value of the driving transistor, a preset correspondence relationship between temperatures and electrical parameters of the driving transistor, and a reference electrical parameter comprises:

determining a real-time mobility corresponding to the temperature value of the driving transistor according to a preset correspondence relationship between temperatures and mobilities;

determining a real-time threshold voltage corresponding to the temperature value of the driving transistor according to a preset correspondence relationship between temperatures and threshold voltages;

determining a mobility offset of the driving transistor according to the reference mobility and the real-time mobility; and determining a threshold voltage offset of the driving transistor according to the reference threshold voltage and the real-time threshold voltage, wherein the electrical parameter offset comprises the mobility offset and the threshold voltage offset.

According to a second aspect of the embodiments of the present disclosure, there is provided a temperature compensation device for a display apparatus, comprising:

a processor; and a memory coupled to the processor, and having instructions executable by the processor, wherein the instructions, when executed by the processor, cause the processor to be configured to:

determine, according to a photoelectric display signal of the display apparatus and/or an anode voltage signal of a light emitting device in the display apparatus, a temperature value of a driving transistor corresponding to the light emitting device in the display apparatus;

determine, according to the temperature value of the driving transistor, a preset correspondence relationship between temperatures and electrical parameters of the driving transistor, and a reference electrical parameter, an electrical parameter offset of the driving transistor; and determine, according to the electrical parameter offset, a temperature compensation value for a data line signal corresponding to the driving transistor in the display apparatus.

In an embodiment, the processor is further configured to:

determine a first full screen temperature according to a brightness signal of the display apparatus or driving current signals of respective driving transistors in the display apparatus;

determine an internal sensed temperature of the driving transistor according to the anode voltage signal of the light emitting device; and determine the temperature value of the driving transistor according to the first full screen temperature and/or the internal sensed temperature.

In an embodiment, the display apparatus comprises a plurality of pixel units, and the processor is further configured to:

determine brightness signals of respective pixel units according to display data signals of the respective pixel units; and determine the first full screen temperature according to a sum of brightness signals of the respective pixel units of a multi-frame display picture.

In an embodiment, the processor is further configured to:

determine the first full screen temperature according to a sum of driving current signals of the respective driving transistors of a multi-frame display picture.

In an embodiment, the processor is further configured to:

determine the first full screen temperature according to a sum of driving current signals of the respective driving transistors of the multi-frame display picture.

In an embodiment, the processor is further configured to:

acquire an external sensed temperature measured by a temperature sensor disposed outside the display apparatus;

correct the first full screen temperature according to the external sensed temperature to obtain a second full screen temperature; and determine the temperature value of the driving transistor according to the second full screen temperature and/or the internal sensed temperature.

In an embodiment, the electrical parameter of the driving transistor comprises a mobility and a threshold voltage, the reference electrical parameter comprises a reference mobility and a reference threshold voltage, and the processor is further configured to:

determine a real-time mobility corresponding to the temperature value of the driving transistor according to a preset correspondence relationship between temperatures and mobilities;

determine a real-time threshold voltage corresponding to the temperature value of the driving transistor according to a preset correspondence relationship between temperatures and threshold voltages;

determine a mobility offset according to the reference mobility and the real-time mobility; and determine a threshold voltage offset according to the reference threshold voltage and the real-time threshold voltage, wherein the electrical parameter offset comprises the mobility offset and the threshold voltage offset.

According to a third aspect of the embodiments of the present disclosure, there is provided a display apparatus, comprising any temperature compensation device described above.

BRIEF DESCRIPTION OF THE ACCOMPANYING DRAWINGS

In order to more clearly illustrate the technical solutions according to the embodiments of the present disclosure, the accompanying drawings to be used in the description of the embodiments of the present disclosure will be briefly described below. It is obvious that the accompanying drawings in the following description are only some embodiments of the present disclosure. Other accompanying drawings may also be obtained by those of ordinary skill in the art according to these accompanying drawings without any creative work.

Figure 5A:
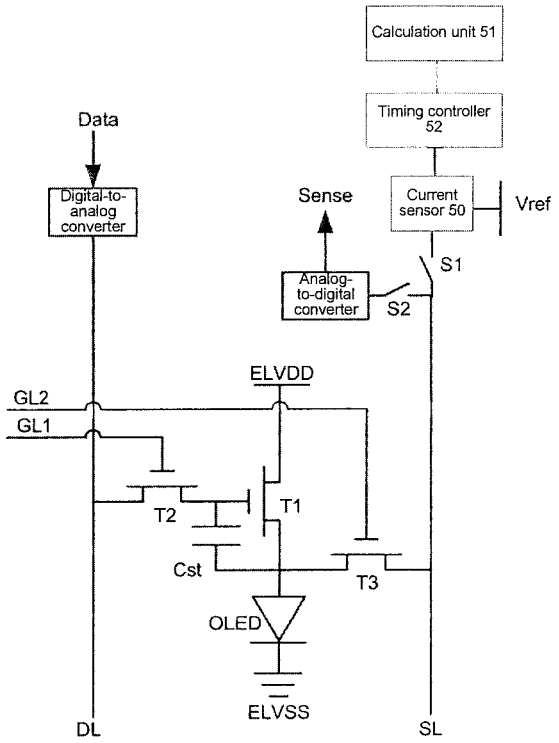
Figure 5B:
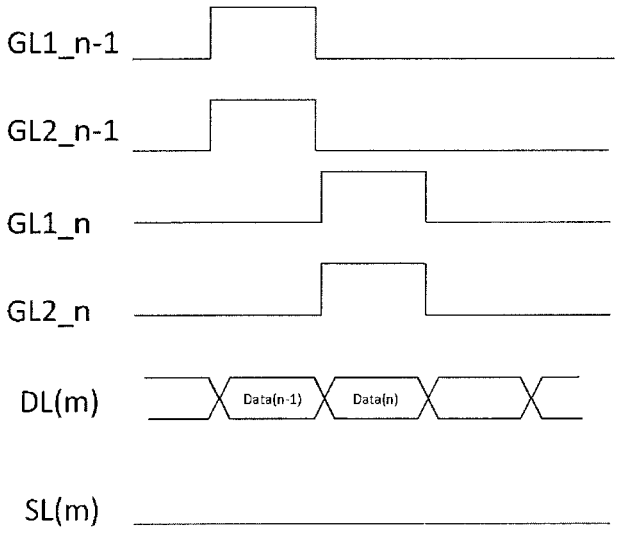
Figure 6A:
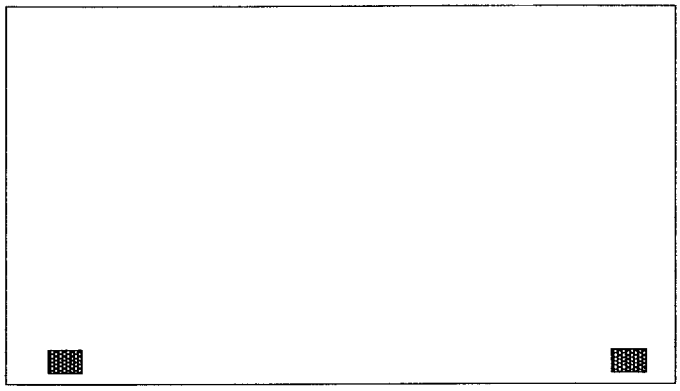
Figure 6B:
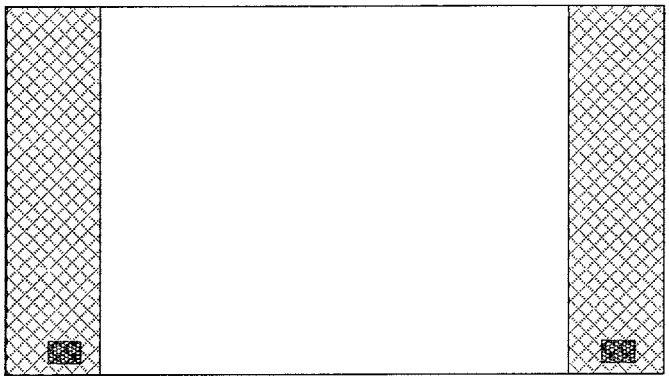
Figure 6C:
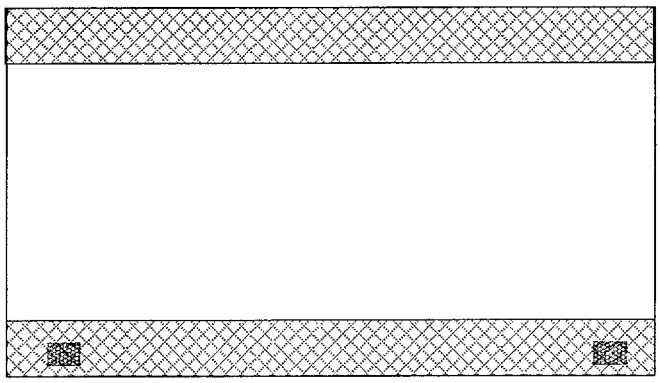
Figure 7:
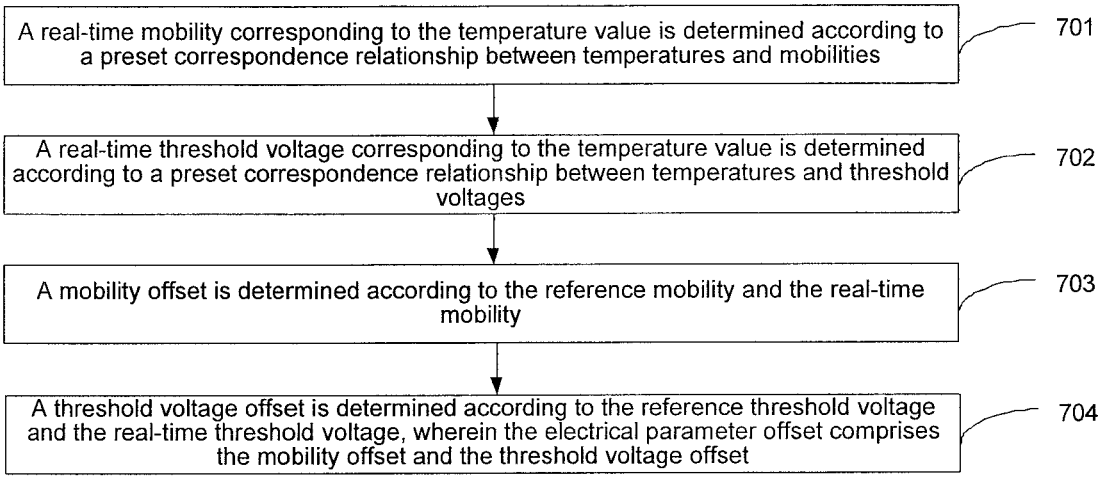
Figure 8:
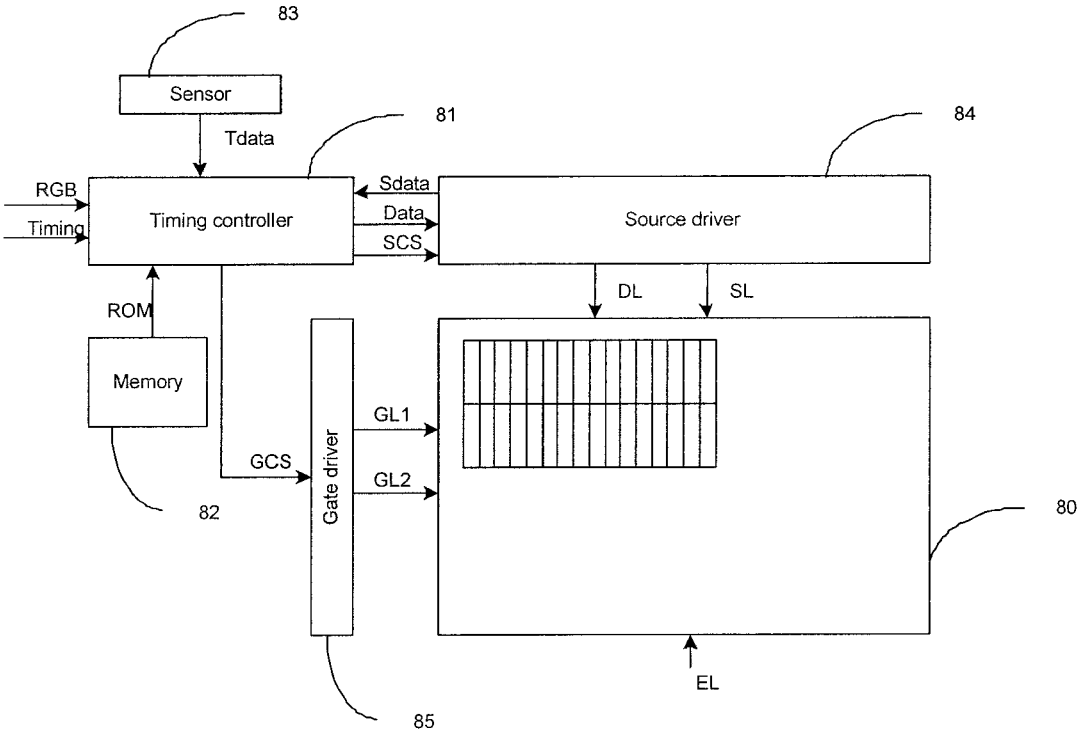
Figure 9:
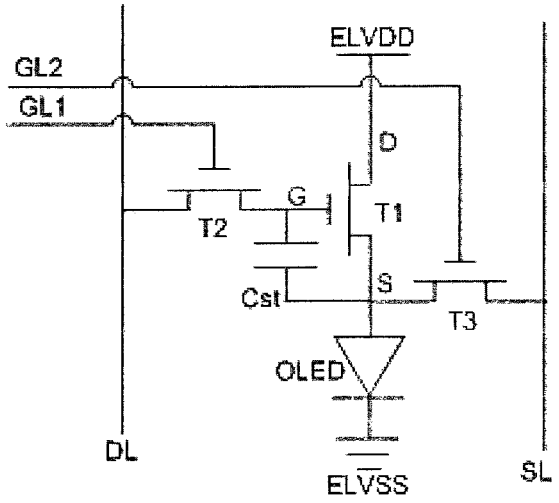
Figure 10:
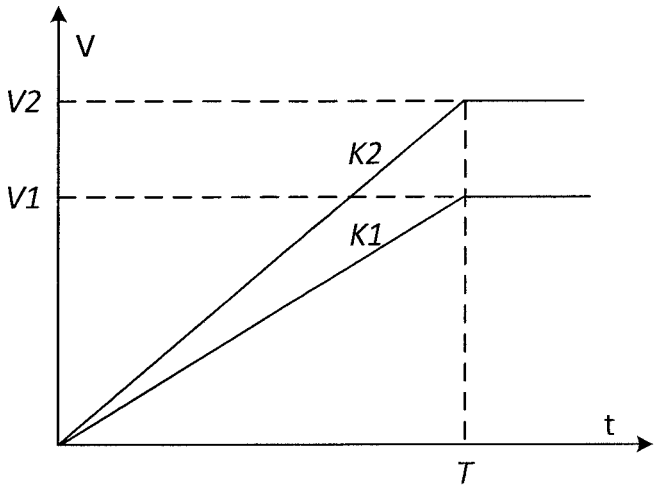
Figure 11:
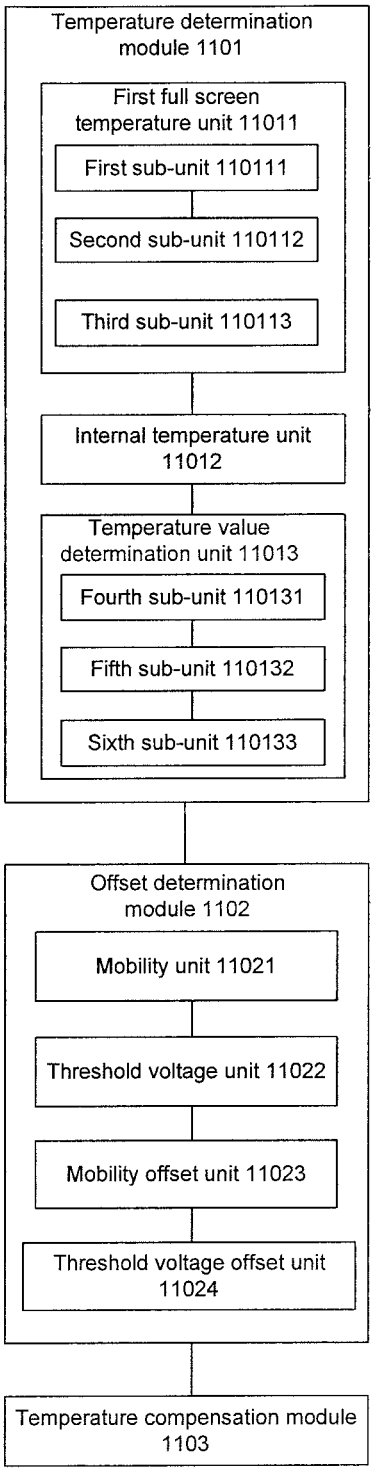
Figure 12:
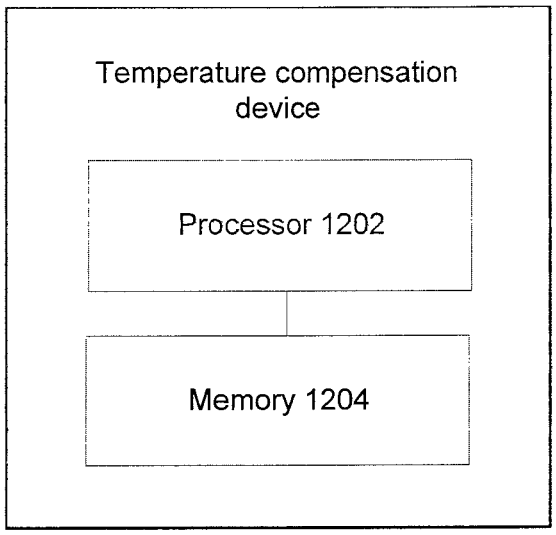

FIG. 5*a* illustrates a schematic structural diagram of a driving current detection circuit according to an embodiment of the present disclosure;

FIG. 5*b* illustrates a timing diagram of signals in a driving current detection process according to an embodiment of the present disclosure;

FIG. 6*a* illustrates a schematic diagram of 16:9 image display and a position where a temperature sensing Integrated Circuit (IC) is placed according to an embodiment of the present disclosure;

FIG. 6*b* illustrates a schematic diagram of 4:3 image display and a position where a temperature sensing IC is placed according to an embodiment of the present disclosure;

FIG. 6*c* illustrates a schematic diagram of 21:9 image display and a position where a temperature sensing IC is placed according to an embodiment of the present disclosure;

FIG. 7 illustrates a flowchart of steps of determining an electrical parameter offset according to an embodiment of the present disclosure;

FIG. 8 illustrates a schematic structural diagram of a display apparatus according to an embodiment of the present disclosure;

FIG. 9 illustrates a schematic structural diagram of a pixel unit driving circuit according to an embodiment of the present disclosure;

FIG. 10 illustrates a schematic diagram of anode voltage curves measured at different temperatures according to an embodiment of the present disclosure;

FIG. 11 illustrates a structural block diagram of a temperature compensation apparatus according to an embodiment of the present disclosure; and FIG. 12 illustrates a schematic structural diagram of a temperature compensation device according to an embodiment of the present disclosure.

DETAILED DESCRIPTION

In order to make the above purposes, features and advantages of the present disclosure more obvious and understandable, the present disclosure will be further described in detail below in conjunction with the accompanying drawings and specific embodiments.

An OLED display apparatus is in a display mode in which brightness is controlled by controlling driving current $I_{OLED}$ using a gate-source voltage difference Vgs of a driving transistor. In practical applications, the display brightness is related not only to the gate-source voltage difference, but also to a mobility K and a threshold voltage Vth of the driving transistor. Current flowing through the driving transistor may be expressed by the following formula:

$$I_{OLED}=1/2K\cdot \mathrm{Cox}\cdot W/L\cdot(V\mathrm{gs}-V\mathrm{th})^2$$

where K is a carrier mobility of the driving transistor, Cox is capacitance of gate oxide, W/L is an aspect ratio of the driving transistor, Vgs is a gate-source voltage difference of the driving transistor, and Vth is a threshold voltage of the driving transistor.

As may be seen from the above formula, the mobility K and the threshold voltage Vth of the driving transistor have a great influence on $I_{OLED}$. In a conventional compensation method, K and Vth of different driving transistors are obtained by means of external sensing in a power-off state, and then an output Vgs is adjusted according to the current calculation formula, the measured K and Vth values, and a brightness value (to obtain theoretical $I_{OLED}$).

Figure 1:
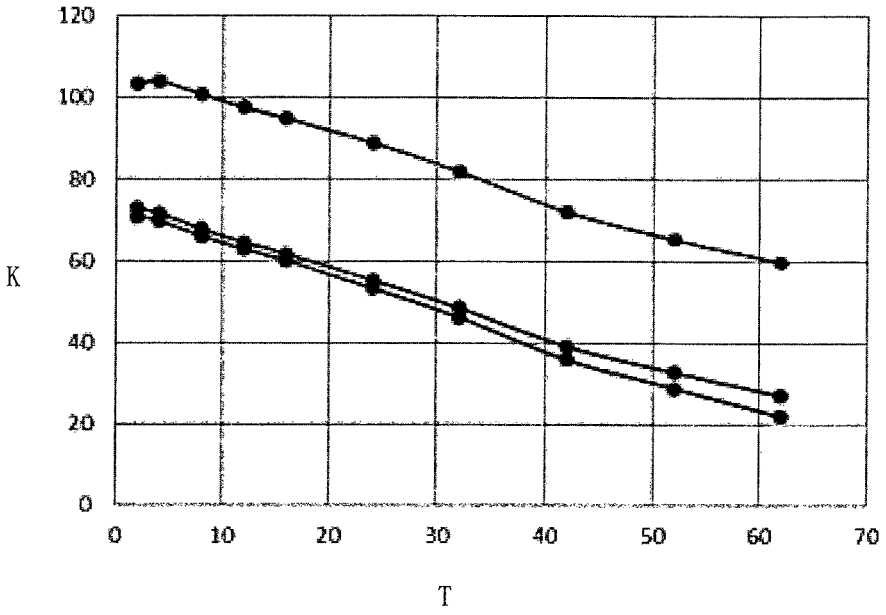
FIG. 1 illustrates a schematic diagram of a change in mobility of a driving transistor with temperature.
Figure 2:
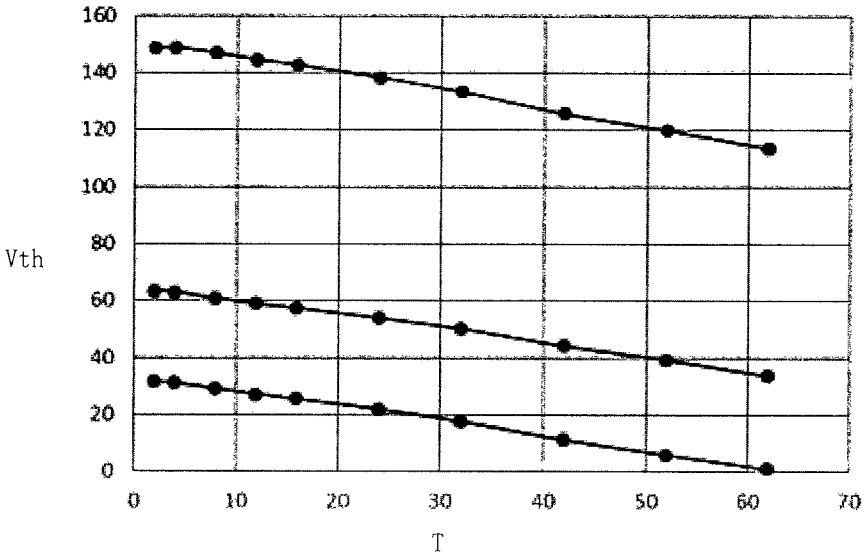
FIG. 2 illustrates a schematic diagram of a change in threshold voltage of a driving transistor with temperature.
Figure 3:
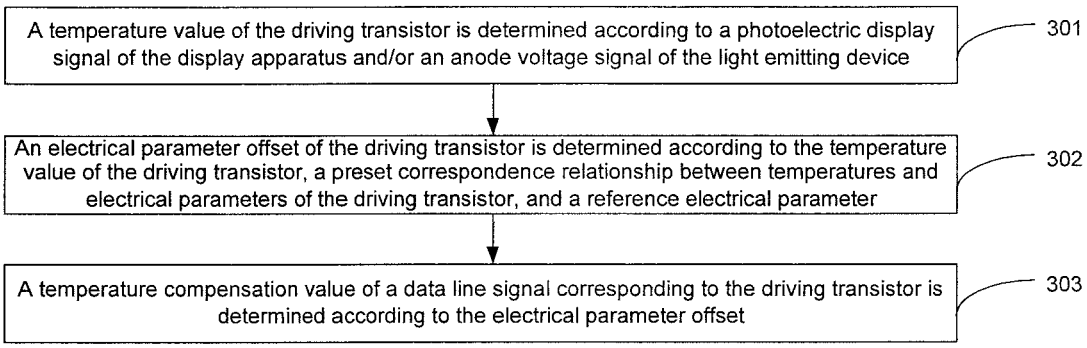
FIG. 3 illustrates a flowchart of steps of a temperature compensation method according to an embodiment of the present disclosure.

However, in the conventional compensation method, K and Vth are obtained in a power-off state. During an actual light emitting process of an OLED display panel, a surface temperature of the display panel may rise, which may result in a change in both K and Vth of the driving transistor. FIGS. 1 and 2 illustrate variation curves of K and Vth at different temperatures. These curves shows that as the temperature rises, both K and Vth of the driving transistor become smaller. In the conventional compensation method, there is no consideration about the influence of the temperature change on the mobility and the threshold voltage of the driving transistor in the display process, and thus inaccurate K and Vth values are obtained, which in turn causes a residual image or Mura to occur on the display apparatus in a case of low brightness. In order to solve this problem, the embodiments of the present disclosure provide a temperature compensation method for a display apparatus. As shown in FIG. 3, the temperature compensation method is used for temperature compensation on a data line signal of the display apparatus, and a driving transistor is used to drive a light emitting device in the display apparatus. The temperature compensation method may comprise the following steps.

In step 301, a temperature value of the driving transistor is determined according to a photoelectric display signal of the display apparatus and/or an anode voltage signal of the light emitting device.

In an embodiment, the display apparatus may comprise a plurality of pixel units, and the photoelectric display signal may be a brightness signal of the display apparatus, driving current signals of the respective pixel units, etc. The brightness signal is converted from input Red, Green, and Blue (RGB) data.

In practical applications, a correspondence relationship between photoelectric display signals and temperatures may be obtained by measurement using experiments, a first temperature corresponding to an actual photoelectric display signal of the display apparatus is obtained by querying the correspondence relationship according to the actual photoelectric display signal, and the temperature value of the driving transistor may be determined according to the first temperature. A correspondence relationship between anode voltage signals of the light emitting device and temperatures may also be obtained by measurement using experiments, a second temperature corresponding to an actual anode voltage signal of the display apparatus may be obtained by querying the correspondence relationship according to the actual anode voltage signal, and the temperature value of the driving transistor may also be determined according to the second temperature. In addition, the temperature value of the driving transistor may also be determined according to the first temperature and the second temperature.

In an embodiment, the data line signal may be, for example, a gate voltage of the driving transistor etc.

In step 302, an electrical parameter offset of the driving transistor is determined according to the temperature value of the driving transistor, a preset correspondence relationship between temperatures and electrical parameters of the driving transistor, and a reference electrical parameter.

In an embodiment, an electrical parameter of the driving transistor, i.e., an electrical measurement parameter of the driving transistor, may comprise, for example, a mobility or a threshold voltage, etc. of the driving transistor. The reference electrical parameter may be measured, for example, in a power-off state. A real-time electrical parameter corresponding to the temperature value may be obtained by querying the preset correspondence relationship between temperatures and electrical parameters of the driving transistor, and the electrical parameter offset of the driving transistor may be determined according to the real-time electrical parameter and the reference electrical parameter.

In step 303, a temperature compensation value of a data line signal corresponding to the driving transistor is determined according to the electrical parameter offset.

Specifically, the temperature compensation value of the data line signal may be calculated according to the electrical parameter offset and the calculation formula of $I_{OLED}$. In practical applications, a final output Vgs may further be calculated according to a temperature compensation value of a data line signal of each of the pixel units and a brightness value (obtained, for example, from RGB display data).

In the present embodiment, the temperature value of the driving transistor is determined according to the photoelectric display signal of the display apparatus and/or the anode voltage signal of the light emitting device, and the electrical parameter offset of the driving transistor is calculated according to the temperature value, to perform real-time temperature compensation on the data line signal (for example, the gate voltage of the driving transistor etc.) During the temperature compensation, the influence of the rise in temperature on the electrical parameter is taken into consideration, which compared with the related art, may avoid the afterimage and the Mura at a low gray level, thereby improving the quality of the display picture.

Figure 4:
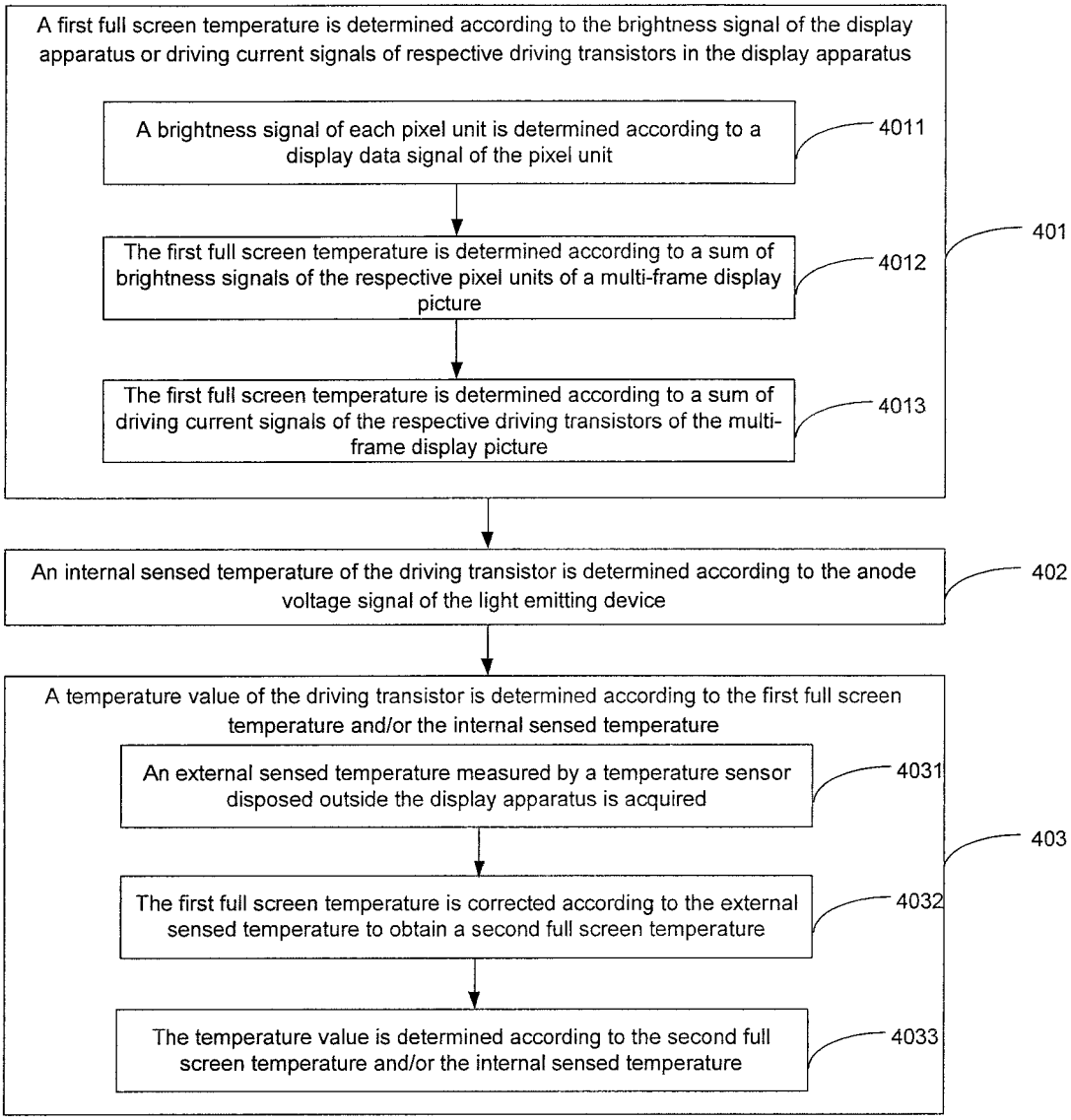
FIG. 4 illustrates a flowchart of steps of determining a temperature value of a driving transistor according to an embodiment of the present disclosure.

In an implementation of the present embodiment, as shown in FIG. 4, the above step 301 may further comprise the following steps.

In step 401, a first full screen temperature is determined according to the brightness signal of the display apparatus or driving current signals of respective driving transistors in the display apparatus.

In an embodiment, the first full screen temperature may be determined according to the brightness signal of the display apparatus, which may specifically comprise the following steps.

In step 4011, a brightness signal of each pixel unit is determined according to a display data signal of the pixel unit.

In an embodiment, the display data signal may be, for example, an RGB data signal input through a graphics card, and the RGB data signal may be converted into brightness signals of the respective pixel units.

In step 4012, the first full screen temperature is determined according to a sum of brightness signals of the respective pixel units of a multi-frame display picture.

A sum of brightness signals of the respective pixel units of each frame display picture may be firstly calculated as frame brightness. A 360-frame display picture is taken as an example of the multi-frame display picture. When a frame number is equal to 360, a sum of frame brightness from a first frame to a $360^{th}$ frame may be calculated, and a first full screen temperature when the frame number is equal to 360 may be determined according to a correspondence relationship between frame brightness and temperatures which is predetermined by experiments. When the frame number is equal to 361, a sum of frame brightness from a second frame to a $361^{st}$ frame may be calculated, and a first full screen temperature when the frame number is equal to 361 may be determined according to the correspondence relationship between frame brightness and temperatures which is predetermined by experiments. In this way, a first full screen temperature TE at each time may be cyclically calculated in real time.

The first full screen temperature may also be determined according to driving current signals of respective driving transistors, which may specifically comprise the following steps.

In step 4013, the first full screen temperature is determined according to a sum of driving current signals of the respective driving transistors of the multi-frame display picture.

A sum of driving current signals of driving transistors in the respective pixel units of each frame display picture may firstly be calculated as full screen current. Here, a 360-frame display picture is taken as an example of the multi-frame display picture. When a frame number is equal to 360, a sum of full screen current from a first frame to a $360^{th}$ frame may be calculated, and a first full screen temperature when the frame number is equal to 360 may be determined according to a correspondence relationship between full screen current and temperatures which is predetermined by experiments. When the frame number is equal to 361, a sum of full screen current from a second frame to a $361^{st}$ frame may be calculated, and a first full screen temperature when the frame number is equal to 361 may be determined according to the correspondence relationship between full screen current and temperatures which is predetermined by experiments. In this way, a first full screen temperature TE at each time may be cyclically calculated in real time.

In an embodiment, in one way, the driving current may be sensed by sensing current values during a frame Blank period (i.e., an idle time between two frames, primarily for external sensing), and then calculating a sum of full screen current. In another way, the driving current may be sensed by sensing a value of current flowing through each row of driving transistor through a source driver and then calculating full screen current by summing the current values.

Specifically, constitutional components of the source driver are as shown in FIG. 5*a*. The source driver mainly comprises a digital-to-analog converter, an analog-to-digital converter, a current sensor, a switch S1, a switch S2, a reference power source Vref, a driving TFT T1, and a switching TFT T2, a sensing TFT T3 and a storage capacitor Cst etc.

The driving TFT T1 has a control electrode connected to a second electrode of T2, a first electrode connected to a first voltage input terminal ELVDD, and a second electrode connected to an anode of a light emitting device OLED, and is configured to generate driving current for driving the light emitting device OLED to emit light according to a voltage at the control electrode.

T2 has a control electrode connected to a second voltage input terminal GL1, a first electrode connected to a third voltage input terminal Data, and the second electrode also connected to a first electrode of the storage capacitor Cst, and is configured to write a third voltage input at the third voltage input terminal Data into the control electrode of T1 according to a second voltage input at the second voltage input terminal GL1. In practical applications, a digital-to-analog converter may be disposed between the third voltage input terminal Data and the first electrode of T2. Here, the third voltage input at the third voltage input terminal Data may be a previous row of compensated data voltage.

T3 has a control electrode connected to a fourth voltage input terminal GL2, and a first electrode connected to a second electrode of the storage capacitor Cst and the second electrode of T1 respectively. As shown in FIG. 5*a*, the source driver further comprises a current sensor 50, a timing controller 52, and a calculation unit 51. T3 has a second electrode connected to the current sensor 50, and is configured to introduce driving current on T1 to the current sensor 50 according to a fourth voltage input at the fourth voltage input terminal GL2.

The current sensor 50 is connected to a fifth voltage input terminal Vref and the timing controller 52 respectively, and is configured to output the driving current to the timing controller 52. In an embodiment, S1 is disposed between the current sensor 50 and the second electrode of T3, and a fifth voltage input at the fifth voltage input terminal Vref may be a voltage at a low potential, such as 0V, 1V, etc.

The timing controller 52 is connected to the calculation unit 51, and is configured to output the driving current of each of the driving transistors T1 of each frame display picture to the calculation unit 51.

The calculation unit 51 is configured to determine a first full screen temperature according to a sum of the driving current signals of the respective driving transistors T1 of a multi-frame display picture.

A timing waveform diagram of each signal in the driving current sensing process is shown in FIG. 5*b*. In a display phase, the gate driver enables gate lines GL1 and GL2 in an $(n-1)^{th}$ row to output a high potential under control of a gate control signal SCS, the switching TFT T2 and the sensing TFT T3 are turned on, the switch S1 of the source driver is turned on, the switch S2 of the source driver is turned off, and a Sensing Line (SL) outputs a voltage of Vref. At this time, a compensated data voltage in the $(n-1)^{th}$ row is stored at the gate of the driving TFT T1, and the voltage of Vref may be applied to the anode of the OLED device or the source of the driving TFT T1. Since the voltage of Vref is a voltage at a low potential (for example, 0V, 1V, etc.), the driving current in the driving TFT T1 may flow through the sensing TFT T3 to SL(m) in an mth column, and then flow into Vref through the current sensor. Since the driving current may pass through the current sensor, the current sensor may sense a current value CDD(n−1) of ELVDD when the $(n-1)^{th}$ row is displayed in real time, and the current sensor may output the current value CDD(n−1) to the timing controller.

Similarly, at a next time, the current sensor may sense a current value CDD(n) of ELVDD when an nth row is displayed in real time, and may output the current value CDD(n) to the timing controller. In this way, the driving current signal of each driving transistor may be measured, and then the full screen current may be calculated.

It should be illustrated that in the implementation, the first full screen temperature is determined according to the sum of the brightness signals and/or the sum of the driving current signals of the multi-frame display picture, which may avoid the influence of single-frame noise etc., thereby improving the accuracy of the full screen temperature. Of course, in practical applications, the first full screen temperature may also be determined according to a sum of brightness signals and/or a sum of driving current signals of a one-frame display picture.

In step 402, an internal sensed temperature of the driving transistor is determined according to the anode voltage signal of the light emitting device.

As shown in FIGS. 1 and 2, if there is a change in temperature, the K and Vth values of the driving transistor may change. As shown in FIG. 10, it is assumed that in an initial (normal temperature) state, a curve of an anode voltage signal of a light emitting device of a certain pixel unit is K1, and a threshold voltage is detected as V1. After display for a period of time, a temperature of the pixel unit may change (for example, the temperature rises). In this case, a curve of the anode voltage signal of the light emitting device is K2, and a threshold voltage is detected as V2. An internal sensed temperature TS(i,j) of the driving transistor (i.e., an internal sensed temperature of a driving transistor in an $i^{th}$ row and a $j^{th}$ column) may be determined according to the actual measured threshold voltages V1 and V2, and a change in Vth with temperature.

In step 403, a temperature value of the driving transistor is determined according to the first full screen temperature and/or the internal sensed temperature.

The temperature value is determined according to the first full screen temperature determined in step 401 and/or the internal sensed temperature determined in step 402. Here, a functional relationship between the first full screen temperature and the internal sensed temperature and the temperature value may be determined according to practical conditions. For example, the temperature value may be determined by adding the first full screen temperature and the internal sensed temperature etc.

In an implementation, the step 403 may specifically comprise the following steps.

In step 4031, an external sensed temperature measured by a temperature sensor disposed outside the display apparatus is acquired.

In step 4032, the first full screen temperature is corrected according to the external sensed temperature to obtain a second full screen temperature.

For a large-size display apparatus, video source signals with different ratios may affect a display area of the display apparatus. Therefore, it needs to correct the first full screen temperature to obtain a second full screen temperature. For example, for a 16:9 OLED display, an image display and a position where a temperature sensing IC (temperature sensor) is placed may be known with reference to FIG. 6*a*. The temperature sensing IC may be placed in a Printed Circuit Board (PCB) of the display apparatus to correct the first full screen temperature according to a sensed temperature. Of course, the position where the temperature sensing IC is placed is not limited to the PCB. For a 4:3 video input, an image display thereof and a position where the temperature sensing IC may be placed may be known with reference to FIG. 6*b*; and for a 21:9 video mode, an image display thereof and a position where the temperature sensing IC may be placed may be known with reference to FIG. 6*c*.

For a picture which is not displayed in full screen, the temperature sensing IC may determine a correction temperature TC, and a second full screen temperature may be determined according to the first full screen temperature TE and the correction temperature TC, i.e., correcting the first full screen temperature by measuring a temperature at a placement position. For example, when black pictures are displayed on left and right sides of a screen, a first full screen temperature of 20° C. may be corrected to a second full screen temperature of 22° C., so that temperature compensation data is more accurate.

In step 4033, the temperature value is determined according to the second full screen temperature and/or the internal sensed temperature.

Here, a functional relationship between the second full screen temperature and the internal sensed temperature and the temperature value may be determined according to practical conditions, for example, the temperature value may be determined by adding the second full screen temperature and the internal sensed temperature or by looking up a table etc. For example, a temperature value T(i,j) of a driving transistor in an $i^{th}$ row and a $j^{th}$ column may be determined to be equal to LUT(TE, TC, TS(i, j)) by looking up the table.

In an implementation of the present embodiment, the electrical parameter of the driving transistor comprises a mobility and a threshold voltage, and the reference electrical parameter comprises a reference mobility and a reference threshold voltage. As shown in FIG. 7, the above step 302 may further comprise the following steps.

In step 701, a real-time mobility corresponding to the temperature value is determined according to a preset correspondence relationship between temperatures and mobilities.

For example, a change amount or variation curve of a K value with temperature of a driving transistor of each pixel unit may be read from a memory ROM to determine a real-time mobility corresponding to a real-time temperature value.

In step 702, a real-time threshold voltage corresponding to the temperature value is determined according to a preset correspondence relationship between temperatures and threshold voltages.

For example, a change amount or variation curve of a threshold voltage with temperature of a driving transistor of each pixel unit may be read from the memory ROM to determine a real-time threshold voltage corresponding to the real-time temperature value.

In step 703, a mobility offset is determined according to the reference mobility and the real-time mobility.

For example, a reference mobility of a driving transistor of each pixel unit may be read from the memory ROM (the reference mobility may be measured in a power-off state), and a mobility offset may be determined by calculating a difference between the reference mobility and the real-time mobility.

In step 704, a threshold voltage offset is determined according to the reference threshold voltage and the real-time threshold voltage, wherein the electrical parameter offset comprises the mobility offset and the threshold voltage offset.

For example, a reference threshold voltage of a driving transistor of each pixel unit may be read from the memory ROM (the reference threshold voltage may be measured in a power-off state), and a threshold voltage offset may be determined by calculating a difference between the reference threshold voltage and the real-time threshold voltage.

In practical applications, the mobility offset and the threshold voltage offset may also be obtained as follows. A mobility offset ΔK and a threshold voltage offset ΔVth are obtained by looking up a table according to change amounts or variation curves of K and Vth with temperature of each pixel unit stored in the memory ROM and based on the temperature value T(i,j). That is, ΔK=LUT(ROM(K),T(i,j)), and ΔVth=LUT(ROM (Vth),T(i,j)).

Then, based on the mobility offset ΔK and the threshold voltage offset ΔVth, and the brightness signal of the corresponding pixel unit (or according to $I_{OLED}$ which is converted from a RGB signal), final output display data Data(i,j) may be determined to be equal to LUT(ΔK)*LUT(RGB)+LUT(ΔVth), a gate voltage Vg of the driving transistor may be determined according to Data(i,j), and thereby the temperature compensation on the gate voltage is completed according to the temperature value of the driving transistor.

For convenience of understanding, a specific implementation of the above steps will be given below.

As shown in FIG. 8, illustrated is an OLED display apparatus according to the present embodiment, which mainly comprises a display panel 80, a timing controller 81, a memory 82, a sensor 83, a source driver 84, a gate driver 85, etc.

Here, the timing controller 81 may receive RGB data which is externally input, a timing control signal TCS, ROM data stored in the memory 82, and internal sensed data Sdata of a pixel output by the source driver 84 (such as an anode voltage signal of a light emitting device, which may be represented by a voltage signal on a sensing line SL) and temperature data TData (such as a temperature of a PCB board, etc.) transmitted by an external sensor. The data is converted, calculated, compensated etc. using algorithms. For example, in an operation phase of the OLED display apparatus, the timing controller 81 generates display data Data and a source control signal SCS, and outputs them to the source driver 84. The timing controller 81 generates a gate control signal GCS and outputs it to the gate driver 85 to finally control normal output of a picture. In a frame blanking phase (an idle time between two frames, mainly for external sensing) of the OLED display apparatus, the timing controller 81 generates display data Data and a source control signal SCS and outputs them to the source driver 84. The timing controller 81 generates a gate control signal GCS and outputs it to the gate driver 85, so as to obtain an internal sensed temperature TS(i,j) in cooperation with the gate driver 85 and the source driver 84.

The memory 82 stores change amounts or variation curves of K and Vth of each sub-pixel with temperature, while storing feature values of different driving TFTs (for example, a reference threshold voltage and a reference mobility K etc. measured in a power-off state).

The sensor 83 may measure information such as a temperature of a display panel through a sensing IC on the PCB, and the sensor 83 transmits a signal such as temperature data TData of the display panel which is measured by the sensing IC to the timing controller 81.

The source driver 84 receives the display data Data and the source control signal SCS, generates a corresponding data voltage, and outputs it to the display panel 80 through a DL. In the display blanking phase, under the control of the source driver 84 and the gate driver 85, the source driver 84 senses optical/electrical feature values of pixels through an SL, generates a sensed voltage signal SData, and outputs it to the timing controller 81.

The gate driver 85 receives the gate control signal GCS, generates a corresponding gate signal, and outputs it to the display panel 80 through a GL.

As shown in FIG. 9, the display panel 80 is composed of a plurality of pixel units. By taking a 3T1C external compensation circuit as an example, each pixel unit comprises at least a data line DL, a sensing line SL, scanning lines GL1 and GL2, a storage capacitor Cst, a switching TFT T1, a driving TFT T2, a sensing TFT T3, an OLED light emitting device, and a pair of light emitting power terminals (ELVDD and ELVSS).

Specifically, the following steps may be performed by the timing controller 81.

Input RGB video data is converted into a brightness signal for each pixel unit.

One or more frames of the brightness signal are received, and a first full screen temperature TE is estimated based on a sum of cyclic brightness during a period of time.

An implementation process of this step may be known with reference to the description of step 401, and will not be described in detail here.

Temperature data TData of an external sensor is received, and a correction temperature TC is determined for correcting the first full screen temperature TE to generate a second full screen temperature.

An implementation process of this step may be known with reference to the description of step 403, and will not be described in detail here.

An internal sensed temperature TS(i,j) of each driving transistor is determined according to a sensed voltage signal SData of each pixel unit (sensed once every fixed time).

An implementation process of this step may be known with reference to the description of step 402, and will not be described in detail here.

Temperature values of the respective driving transistors are calculated according to the first full screen temperature TE, the correction temperature TC, and the internal sensed temperature TS(i,j).

An implementation process of this step may be known with reference to the description of step 403, and will not be described in detail here.

A mobility offset and a threshold voltage offset are calculated according to change amounts or variation curves of K and Vth with temperature of each pixel unit read from a memory ROM, a reference mobility and a reference threshold voltage.

An implementation process of this step may be known with reference to the description of steps 701-704, and will not be described in detail here.

Final output data is determined according to the mobility offset, the threshold voltage offset, and the brightness signal of each pixel unit. Then, a gate voltage Vg of the driving transistor may be determined according to the data, so as to complete the temperature compensation on the gate voltage according to the temperature value of the driving transistor.

Another embodiment of the present disclosure further provides a temperature compensation apparatus for temperature compensation on a data line signal of the display apparatus, and a driving transistor is used to drive a light emitting device in the display apparatus. As shown in FIG. 11, the temperature compensation apparatus may comprise a temperature determination module 1101, an offset determination module 1102 and a temperature compensation module 1103.

The temperature determination module 1101 is configured to determine a temperature value of the driving transistor corresponding to the light emitting device in the display apparatus according to a photoelectric display signal of the display apparatus and/or an anode voltage signal of the light emitting device in the display apparatus.

In an embodiment, the display apparatus may comprise a plurality of pixel units, and the photoelectric display signal may be a brightness signal of the display apparatus, driving current signals of the respective pixel units, etc. In practical applications, for example, a correspondence relationship between photoelectric display signals and temperatures of the display apparatus and a correspondence relationship between anode voltage signals and temperatures of the display apparatus may be obtained by measurement using experiments. The temperature determination module 1101 queries these correspondence relationships respectively according to the photoelectric display signal and/or the anode voltage signal of the light emitting device, and may determine the temperature value of the driving transistor by performing calculation based on the temperatures which are obtained by query.

The offset determination module 1102 is configured to determine an electrical parameter offset of the driving transistor according to the temperature value of the driving transistor, a preset correspondence relationship between temperatures and electrical parameters of the driving transistor, and a reference electrical parameter.

In an embodiment, an electrical parameter of the driving transistor may comprise electrical parameters such as a mobility or a threshold voltage, etc. of the driving transistor. The reference electrical parameter may be measured, for example, in a power-off state. The offset determination module 1102 may obtain a real-time electrical parameter corresponding to the temperature value by querying the preset correspondence relationship between temperatures and electrical parameters of the driving transistor, and may determine the electrical parameter offset of the driving transistor according to the real-time electrical parameter and the reference electrical parameter.

The temperature compensation module 1103 is configured to determine a temperature compensation value of a data line signal according to the electrical parameter offset.

Specifically, the temperature compensation module 1103 may calculate the temperature compensation value of the data line signal according to the electrical parameter offset and the calculation formula of $I_{OLED}$. In practical applications, the temperature compensation module 1103 may further calculate final output data Vgs according to a temperature compensation value of a data line signal of each of the pixel units and a brightness value (obtained, for example, from RGB display data).

In an implementation of the present embodiment, the temperature determination module 1101 may comprise:

a first full screen temperature unit 11011 configured to determine a first full screen temperature according to the brightness signal of the display apparatus or driving current signals of respective driving transistors in the display apparatus;

an internal temperature unit 11012 configured to determine an internal sensed temperature of the driving transistor according to the anode voltage signal of the light emitting device; and a temperature value determination unit 11013 configured to determine the temperature value according to the first full screen temperature and/or the internal sensed temperature.

Specifically, the display apparatus comprises a plurality of pixel units, and the full screen temperature unit 11011 may further comprise:

a first sub-unit 110111 configured to determine brightness signals of respective pixel units according to display data signals of the respective pixel unit; and a second sub-unit 110112 configured to determine the first full screen temperature according to a sum of brightness signals of the respective pixel units of a multi-frame display picture.

The full screen temperature unit 11011 may further comprise:

a third sub-unit 110113 configured to determine the first full screen temperature according to a sum of driving current signals of the respective driving transistors of the multi-frame display picture.

In an embodiment, the third sub-unit 110113 may further comprise a calculation unit configured to determine the first full screen temperature according to a sum of driving current signals of the respective driving transistors T1 of the multi-frame display picture.

In an embodiment, the temperature value determination unit 11013 may comprise:

a fourth sub-unit 110131 configured to acquire an external sensed temperature measured by a temperature sensor disposed outside the display apparatus;

a fifth sub-unit 110132 configured to correct the first full screen temperature according to the external sensed temperature to obtain a second full screen temperature; and a sixth sub-unit 110133 configured to determine the temperature value according to the second full screen temperature and/or the internal sensed temperature.

Specifically, the electrical parameter of the driving transistor comprises a mobility and a threshold voltage, and the reference electrical parameter comprises a reference mobility and a reference threshold voltage. The offset determination module 1102 may comprise:

a mobility unit 11021 configured to determine a real-time mobility corresponding to the temperature value according to a preset correspondence relationship between temperatures and mobilities;

a threshold voltage unit 11022 configured to determine a real-time threshold voltage corresponding to the temperature value according to a preset correspondence relationship between temperatures and threshold voltages;

a mobility offset unit 11023 configured to determine a mobility offset according to the reference mobility and the real-time mobility; and a threshold voltage offset unit 11024 configured to determine a threshold voltage offset according to the reference threshold voltage and the real-time threshold voltage, wherein the electrical parameter offset comprises the mobility offset and the threshold voltage offset.

The temperature compensation apparatus according to the present embodiment may implement various processes and effects in any of the embodiments of the temperature compensation method described above, and will not be described in detail here to avoid repetition.

Another embodiment of the present disclosure further provides a display apparatus, which may comprise the temperature compensation device according to any of the embodiments.

It should be illustrated that the display apparatus according to the present embodiment may be any product or component having a display function, such as a display panel, an electronic paper, a mobile phone, a tablet computer, a television, a notebook computer, a digital photo frame, a navigator, etc.

The embodiments of the present disclosure further provide a temperature compensation device for a display apparatus, of which a structural block diagram is shown in FIG. 12. The temperature compensation device comprises a processor 1202 and a memory 1204. It should be illustrated that a structure in the structural diagram of the temperature compensation device shown in FIG. 12 is merely exemplary and not restrictive, and the temperature compensation device may further comprise other components depending on practical application requirements.

In an embodiment of the present disclosure, the processor 1202 and the memory 1204 may communicate with each other directly or indirectly. The processor 1202 may communicate with components such as the memory 1204 via a connection through a network. The network may comprise a wireless network, a wired network, and/or any combination thereof. The network may comprise a local area network, the Internet, a telecommunications network, an Internet of Things based on the Internet and/or telecommunications network, and/or any combination thereof etc. The wired network may be used for communication by means of twisted pair, a coaxial cable or optical fiber transmission etc., and the wireless network may use a communication manner such as a 3G/4G/5G mobile communication network, Bluetooth, Zigbee or WiFi etc. A type and a function of the network may not be limited here in the present disclosure.

The processor 1202 may control other components in the temperature compensation device for the display apparatus to perform desired functions. The processor 1202 may be a device having a data processing capability and/or a program execution capability, such as a Central Processing Unit (CPU), or a Graphics Processing Unit (GPU), etc. The CPU may be an X86 or ARM architecture etc. The GPU may be directly integrated into a motherboard or built into a Northbridge of the motherboard. The GPU may also be built into the CPU.

The memory 1204 may comprise any combination of one or more computer program products, which may comprise various forms of computer readable storage media, such as a volatile memory and/or a nonvolatile memory. The volatile memory may comprise, for example, a Random Access Memory (RAM) and/or a cache etc. The non-volatile memory may comprise, for example, a Read Only Memory (ROM), a hard disk, an Erasable Programmable Read Only Memory (EPROM), a portable Compact Disk Read Only Memory (CD-ROM), a Universal Serial Bus (USB) memory, a flash memory, etc.

One or more computer readable codes or instructions may be stored in the memory 1204, and the processor 1202 may execute the computer instructions to implement the temperature compensation methods for the display apparatus described above. A detailed description of a processing procedure of the temperature compensation methods for the display apparatus may be known with reference to the related description of the temperature compensation methods for the display apparatus according to the embodiments of the present disclosure, and will not be described in detail. Various applications and various data, such as image data sets and various data used and/or generated by the applications, etc., may also be stored in the computer readable storage medium.

The embodiments of the present disclosure provide a temperature compensation method and device, and a display apparatus. The temperature compensation method comprises: determining, according to a photoelectric display signal of the display apparatus and/or an anode voltage signal of a light emitting device in the display apparatus, a temperature value of a driving transistor corresponding to the light emitting device in the display apparatus; determining an electrical parameter offset of the driving transistor according to the temperature value of the driving transistor, a preset correspondence relationship between temperatures and electrical parameters of the driving transistor, and a reference electrical parameter; and determining, according to the electrical parameter offset, a temperature compensation value for a data line signal. In the embodiment of the present disclosure, the temperature value of the driving transistor is determined according to the photoelectric display signal of the display apparatus and/or the anode voltage signal of the light emitting device, and the electrical parameter offset of the driving transistor is calculated according to the temperature value, to perform real-time temperature compensation on the data line signal (for example, the gate voltage of the driving transistor) During the temperature compensation, the influence of the rise in temperature on the electrical parameter is taken into consideration, which compared with the related art, may avoid the afterimage and the Mura at a low gray level, thereby improving the quality of the display picture.

Various embodiments in the present specification are described in a progressive manner, each embodiment focuses on differences from other embodiments, and the same or similar parts between the respective embodiments may be known with reference to each other.

Finally, it should also be illustrated that relational terms such as first and second etc. herein are merely used to distinguish one entity or operation from another entity or operation, and do not necessarily require or imply that there is any such actual relationship or order between these entities or operations. Further, the terms "comprises", "comprising" or any other variations thereof are intended to encompass a non-exclusive inclusion, so that a process, method, commodity or device including a series of elements not only comprises these elements, but also comprises elements which are not explicitly listed or elements which are inherent to such a process, method, commodity, or device. Without more restrictions, an element defined by a phrase "comprising a . . . " does not exclude the presence of additional equivalent elements in a process, method, commodity, or device including the element.

The above description is a detailed description of the temperature compensation method and device and the display apparatus according to the present disclosure. The principles and implementations of the present disclosure have been described herein by using specific examples. The description of the above embodiments is only used for facilitating understanding the method according to the present disclosure and a core idea thereof. At the same time, it is apparent to those skilled in the art according to the idea of the present disclosure that there will be changes in specific implementations and an application scope. In summary, content of the specification should not be understood as limiting the present disclosure.

We claim:

1. A temperature compensation method for a display apparatus, comprising:

determining, according to a photoelectric display signal of the display apparatus and/or an anode voltage signal of a light emitting device in the display apparatus, a temperature value of a driving transistor corresponding to the light emitting device in the display apparatus;

determining, according to the temperature value of the driving transistor, a preset correspondence relationship between temperatures and electrical parameters of the driving transistor, and a reference electrical parameter, an electrical parameter offset of the driving transistor; and determining, according to the electrical parameter offset, a temperature compensation value for a data line signal corresponding to the driving transistor in the display apparatus, wherein the electrical parameter of the driving transistor comprises a mobility and a threshold voltage, the reference electrical parameter comprises a reference mobility and a reference threshold voltage, and determining an electrical parameter offset of the driving transistor according to the temperature value of the driving transistor, a preset correspondence relationship between temperatures and electrical parameters of the driving transistor, and a reference electrical parameter comprises:

determining a real-time mobility corresponding to the temperature value of the driving transistor according to a preset correspondence relationship between temperatures and mobilities;

determining a real-time threshold voltage corresponding to the temperature value of the driving transistor according to a preset correspondence relationship between temperatures and threshold voltages;

determining a mobility offset of the driving transistor according to the reference mobility and the real-time mobility; and determining a threshold voltage offset of the driving transistor according to the reference threshold voltage and the real-time threshold voltage, wherein the electrical parameter offset comprises the mobility offset and the threshold voltage offset.

2. The temperature compensation method according to claim 1, wherein determining a temperature value of the driving transistor comprises:

determining a first full screen temperature according to brightness signals of the display apparatus or driving current signals of respective driving transistors in the display apparatus;

determining an internal sensed temperature of the driving transistor according to the anode voltage signal of the light emitting device; and determining the temperature value of the driving transistor according to the first full screen temperature and/or the internal sensed temperature.

3. The temperature compensation method according to claim 2, wherein the display apparatus comprises a plurality of pixel units, and determining a first full screen temperature according to brightness signals of the display apparatus comprises:

determining brightness signals of respective pixel units according to display data signals of the respective pixel units; and determining the first full screen temperature according to a sum of brightness signals of the respective pixel units of a multi-frame display picture.

4. The temperature compensation method according to claim 2, wherein determining a first full screen temperature according to driving current signals of respective driving transistors comprises:

determining the first full screen temperature according to a sum of driving current signals of the respective driving transistors of a multi-frame display picture.

5. The temperature compensation method according to claim 2, wherein determining the temperature value of the driving transistor according to the first full screen temperature and/or the internal sensed temperature comprises:

acquiring an external sensed temperature measured by a temperature sensor disposed outside the display apparatus;

correcting the first full screen temperature according to the external sensed temperature to obtain a second full screen temperature; and determining the temperature value of the driving transistor according to the second full screen temperature and/or the internal sensed temperature.

6. A temperature compensation device for a display apparatus, comprising:

a processor; and a memory coupled to the processor, and having instructions executable by the processor, wherein the instructions, when executed by the processor, cause the processor to be configured to:

determine, according to a photoelectric display signal of the display apparatus and/or an anode voltage signal of a light emitting device in the display apparatus, a temperature value of a driving transistor corresponding to the light emitting device in the display apparatus;

determine, according to the temperature value of the driving transistor, a preset correspondence relationship between temperatures and electrical parameters of the driving transistor, and a reference electrical parameter, an electrical parameter offset of the driving transistor; and determine, according to the electrical parameter offset, a temperature compensation value for a data line signal corresponding to the driving transistor in the display apparatus, wherein the electrical parameter of the driving transistor comprises a mobility and a threshold voltage, the reference electrical parameter comprises a reference mobility and a reference threshold voltage, and the processor is further configured to:

determine a real-time mobility corresponding to the temperature value of the driving transistor according to a preset correspondence relationship between temperatures and mobilities;

determine a real-time threshold voltage corresponding to the temperature value of the driving transistor according to a preset correspondence relationship between temperatures and threshold voltages;

determine a mobility offset according to the reference mobility and the real-time mobility; and determine a threshold voltage offset according to the reference threshold voltage and the real-time threshold voltage, wherein the electrical parameter offset comprises the mobility offset and the threshold voltage offset.

7. The temperature compensation device according to claim 6, wherein the processor is further configured to:

determine a first full screen temperature according to a brightness signal of the display apparatus or driving current signals of respective driving transistors in the display apparatus;

determine an internal sensed temperature of the driving transistor according to the anode voltage signal of the light emitting device; and determine the temperature value of the driving transistor according to the first full screen temperature and/or the internal sensed temperature.

8. The temperature compensation device according to claim 7, wherein the display apparatus comprises a plurality of pixel units, and the processor is further configured to:

determine brightness signals of respective pixel units according to display data signals of the respective pixel units; and determine the first full screen temperature according to a sum of brightness signals of the respective pixel units of a multi-frame display picture.

9. The temperature compensation device according to claim 7, wherein the processor is further configured to:

determine the first full screen temperature according to a sum of driving current signals of the respective driving transistors of a multi-frame display picture.

10. The temperature compensation device according to claim 9, wherein the processor is further configured to:

determine the first full screen temperature according to a sum of driving current signals of the respective driving transistors of the multi-frame display picture.

11. The temperature compensation device according to claim 7, wherein the processor is further configured to:

acquire an external sensed temperature measured by a temperature sensor disposed outside the display apparatus;

correct the first full screen temperature according to the external sensed temperature to obtain a second full screen temperature; and determine the temperature value of the driving transistor according to the second full screen temperature and/or the internal sensed temperature.

12. A display apparatus, comprising the temperature compensation device according to claim 6.

* * * * *